US006400388B1

(12) United States Patent
Imai

(10) Patent No.: US 6,400,388 B1
(45) Date of Patent: Jun. 4, 2002

(54) THICK FILM THERMAL HEAD AND METHOD OF MAKING THE SAME

(75) Inventor: Ryoichi Imai, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/635,657

(22) Filed: Aug. 10, 2000

(30) Foreign Application Priority Data

Aug. 11, 1999 (JP) ..... 11-227330
Jul. 14, 2000 (JP) ..... 2000-214658

(51) Int. Cl.[7] ..... B41J 2/335; B41J 3/24
(52) U.S. Cl. ..... 347/208; 101/127; 347/200
(58) Field of Search ..... 347/200, 202, 347/203, 206, 208, 204; 101/114, 127

(56) References Cited

U.S. PATENT DOCUMENTS 4,259,564 A * 3/1981 Ohkubo et al. ..... 347/208
4,777,583 A * 10/1988 Minami et al. ..... 347/208
5,072,236 A * 12/1991 Tatsumi et al. ..... 347/203
6,253,447 B1 * 7/2001 Nakamura et al. ..... 347/208

FOREIGN PATENT DOCUMENTS

| | | |
|---|---|---|
| EP | 0838341 A | 4/1998 |
| JP | 63 165153 | 7/1988 |
| JP | 63-165153 | 7/1988 |
| JP | 03 047757 | 2/1991 |

* cited by examiner

*Primary Examiner*—N. Le
*Assistant Examiner*—K. Feggins
(74) *Attorney, Agent, or Firm*—Nixon Peabody LLP; Donald R. Studebaker

(57) ABSTRACT

A thick film thermal head includes an electrical insulating substrate. A pair of heat-resistant electrical insulating plates fixed to a surface of the substrate with their side faces opposed to each other with a gap between. An elongated resistance heater is embedded in the gap, and a plurality of electrodes are formed on the surface of the heat-resistant electrical insulating plates in contact with the resistance heater and arranged in the longitudinal direction of the resistance heater.

11 Claims, 4 Drawing Sheets

THICK FILM THERMAL HEAD AND METHOD OF MAKING THE SAME

BACKGROUND OF THE INVENTION

1. Field of the Invention

This invention relates to a thick film thermal head which is employed to thermally perforate a stencil material to make a stencil to be used in an image forming apparatus such as a stencil printer and to a method of making the same.

2. Description of the Related Art

As the thermal head used in various image forming apparatuses, there have been known a thin film thermal head and a thick film thermal head. The former is formed by the use of thin film forming technique and the latter is formed by the use of technique other than the thin film forming technique. When perforating a heat-sensitive stencil material by the use of such a thermal head, it is required that adjacent perforations are clearly separated in order to obtain a high printing quality.

A thick film thermal head has been used in a heat-sensitive printing system and a ribbon transfer printing system. The thick film thermal head comprises an insulator substrate such as of ceramic, a plurality of electrodes formed on the substrate and a resistance heater formed on the electrodes. When power is supplied to the electrodes, the resistance heater generates heat from the lower surface thereof in contact with the electrodes and the heat propagates the resistance heater to the upper surface thereof where the resistance heater is brought into contact with a recording medium. In this thermal head, the resistance heater extends across the electrodes and the parts of the resistance heater between the electrodes form resistance heater elements, and each pixel of the image formed by the thermal head becomes larger than the heater element, which results in pixels contiguous to each other.

When the thick film thermal head is used for making a stencil, each of the perforations becomes too large since the heat generated from the lower surface of each of the resistance heater elements spreads over a wide area while the heat propagates to the upper surface of the heat element, and at the same time, it takes a long time for the temperature of the surface of each heater element to reach a perforating temperature, which results in poor response of the thermal head.

Further, in the case of a stencil printer, ink is apt to spread when transferred to the printing paper through the perforations of the stencil and is apt to form printing dots larger than the perforations of the stencil. Accordingly, the perforations of the stencil should be smaller by an amount corresponding to spread of the ink and should be discrete from each other. From this viewpoint, the aforesaid thermal head where heat is generated from the lower surface of the resistance heater elements is not suitable for making a stencil.

In a thermal head having a linear array of resistance heater elements extending in a main scanning direction (in the direction of width of a stencil), though the size of the perforations in the main scanning direction can be reduced by narrowing the intervals at which the electrodes are arranged, it is difficult to reduce the size of the perforations in the sub-scanning direction (the direction in which the stencil is conveyed) due to difficulties in narrowing the width of the resistance heater and influence of heat diffusion.

That is, conventionally, the thick film thermal head is formed by coating resistance heater paste by silk screening on electrodes b formed on a substrate a as shown in FIG. 9.

Though the resistance heater paste forms a narrow protrusion as shown by chained line c immediately after coating, it is flattened in the sub-scanning direction with lapse of time as shown by the solid line d. This phenomenon occurs because the resistance heater paste is flowable and there is provided no member for limiting spread of the paste, and makes it difficult to form a narrow resistance heater.

As disclosed, for instance, in Japanese Unexamined Patent Publication No. 63(1988)-165153, there has been proposed a structure in which a heat accumulator layer is formed on an insulating substrate such as of ceramic, a resistance heater is embedded in a groove formed on the heat accumulator layer, and electrodes are formed over the resistance heater for the purpose of making each heat generating area larger than the resistance heater element corresponding thereto and making the pixels contiguous to each other. However this structure of a thermal head is not suitable for making a stencil. That is, when the thermal head is used for thermally perforating a heat-sensitive stencil material, heat generated by each resistance heater element accumulates in the heat accumulator layer and spreads wide, which can result in enlarged or connected perforations. Further the heat accumulator layer deteriorates the speed of response to heat (heat dissipating speed).

There has been known also a thick film thermal head in which a resistance heater in the form of a protrusion is formed on electrodes on a substrate. This type of thermal head is disadvantageous in that paper grounds or resin grounds is peeled off the stencil material by the protruding resistance heater when the stencil material is moved relative to the thermal head during stencil making. The paper grounds or the resin grounds adheres to the surface of the protruding resistance heater and adversely 15 affects stencil making, e.g., prevents the resistance heater from being brought into a close contact with the stencil material and causes the resistance heater to fail in perforating the stencil material.

Due to the difficulties described above, a thin film thermal head has been generally employed for perforating a heat-sensitive stencil material. The thin film thermal head is advantageous in that the resistance heater is of a thin film and accordingly the heat generating area for each resistance heater element can be small, which results in small perforations. However, the thin film thermal head is disadvantageous in that its manufacturing cost is high. That is, the thin film thermal head is manufactured by the use of semiconductor manufacturing technology and expensive apparatuses such as a sputtering apparatus or a vacuum deposition apparatus and high technique are required. At the same time, materials for forming the thermal head are expensive. Further, the semiconductor manufacturing apparatuses are generally for making integral circuits and the like and are not able to produce a large size (e.g., for A2 or larger size) thermal head by one step. Accordingly, a large size thermal head must be produced by incorporating a plurality of small thermal head segments, which gives rise to a problem that heat generation becomes unsatisfactory at junctions between the segments, which can result in white stripes on prints.

To the contrast, the thick film thermal head can be made at low cost, for instance, by screen printing, and can be easily made in a large size.

SUMMARY OF THE INVENTION

In view of the foregoing observations and description, the primary object of the present invention is to provide a thick film thermal head which is improved in perforating properties.

That is, the primary object of the present invention is to provide a thermal head which can be produced at low cost and in a large size and, at the same time, can form small discrete perforations in a heat-sensitive stencil material at high response to heat.

Another object of the present invention is to provide a method of making such a thick film thermal head.

In accordance with a first aspect of the present invention, there is provided a thick film thermal head comprising an electrical insulating substrate, a pair of heat-resistant electrical insulating plates fixed to a surface of the substrate with their side faces opposed to each other with a gap therebetween, an elongated resistance heater embedded in the gap, and a plurality of electrodes which are formed on the surface of the heat-resistant electrical insulating plates in contact with the resistance heater and arranged in the longitudinal direction of the resistance heater.

It is preferred that the electrodes comprise alternate first and second electrodes and the parts of the elongated resistance heater between the first and second electrodes generate heat when electric power is applied across the first and second electrodes.

It is preferred that the substrate is of calcined ceramic.

A spacer means may be disposed between the heat-resistant electrical insulating plates to define the width of the gap.

In this case it is preferred that the spacer means comprises a small ball or a small cylindrical body.

It is preferred that the heat-resistant electrical insulating plates be fixed to the surface of the substrate by adhesive. Preferably, the heat-resistant electrical insulating plates be of heat-resistant resin.

In accordance with a second aspect of the present invention, there is provided a method of making a thick film thermal head comprising the steps of positioning a pair of heat-resistant electrical insulating plates on a surface of an electrical insulating substrate so that side surfaces of the heat-resistant electrical insulating plates are opposed to each other with a spacer means therebetween to form a gap therebetween, fixing heat-resistant electrical insulating plates to the substrate, embedding an elongated resistance heater in the gap, and providing a plurality of electrodes in the longitudinal direction of the resistance heater on the surface of the heat-resistant electrical insulating plates in contact with the resistance heater.

The spacer means may be removed after the heat-resistant electrical insulating plates are fixed to the substrate.

In accordance with the present invention, since the resistance heater is embedded in the gap, the width of the resistance heater is limited to the width of the gap. Further, since the electrodes are in contact with the surface of the resistance heater which is brought into contact with the stencil material when making a stencil, heat is generated from the surface of the resistance heater which is brought into contact with the stencil material and applied to the stencil material before propagating over a large distance and spreading wide. Accordingly, with the thermal head of the present invention, perforations can be small even in the sub-scanning direction and the quality of the stencil can be improved so that the printing dots can be sufficiently small in size and the printing quality is improved. Further since being of a thick film type, the thermal head of the present invention can be produced at low cost without using a semiconductor manufacturing apparatus and can be produced in a large size. Accordingly, even a large size thermal head can be employed in printing without fear of generating a white stripe on prints.

Further, since heat which does not contribute to perforation of the stencil material is dissipated through the side walls and the bottom of the gap, the thermal head of the present invention is increased in its response to heat and can be operated at a high speed.

Further, by positioning the heat-resistant electrical insulating plates with a spacer means interposed therebetween, a gap which is thin and uniform in width can be easily formed between the heat-resistant electrical insulating plates. Especially when the spacer means comprises a small ball or a small cylindrical body which can be formed with little fluctuation in dimension, the gap can be more uniform in width and the resistance heater embedded in the gap can be more accurate in dimension, whereby excellent heat generating properties can be obtained.

DESCRIPTION OF THE PREFERRED EMBODIMENT

Figure 1:
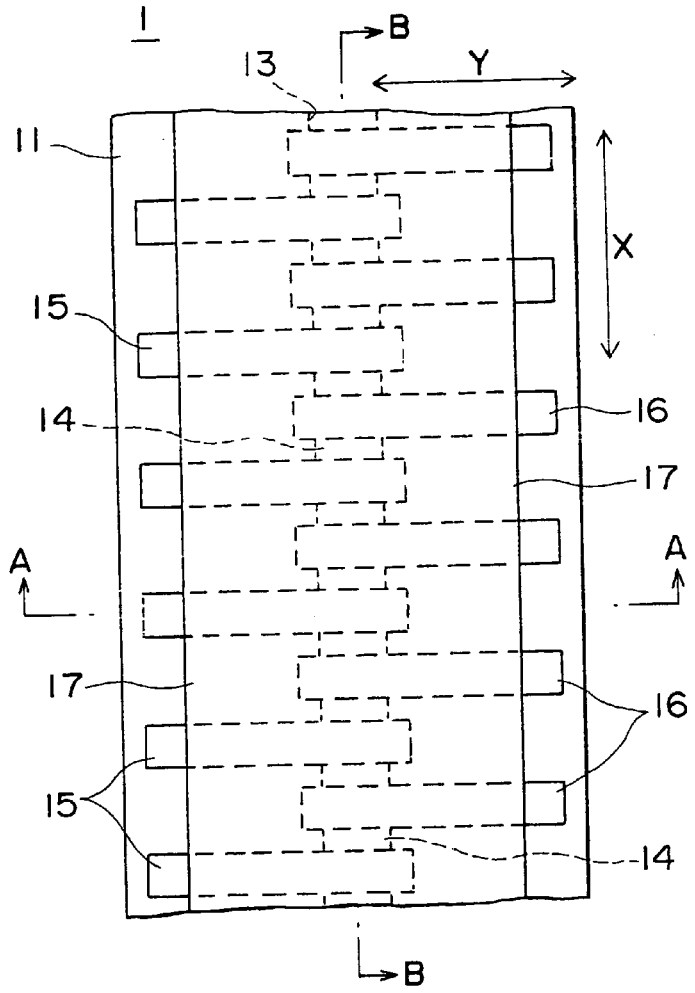
FIG. 1 is a fragmentary plan view of a thermal head in accordance with an embodiment of the present invention.
Figure 2:
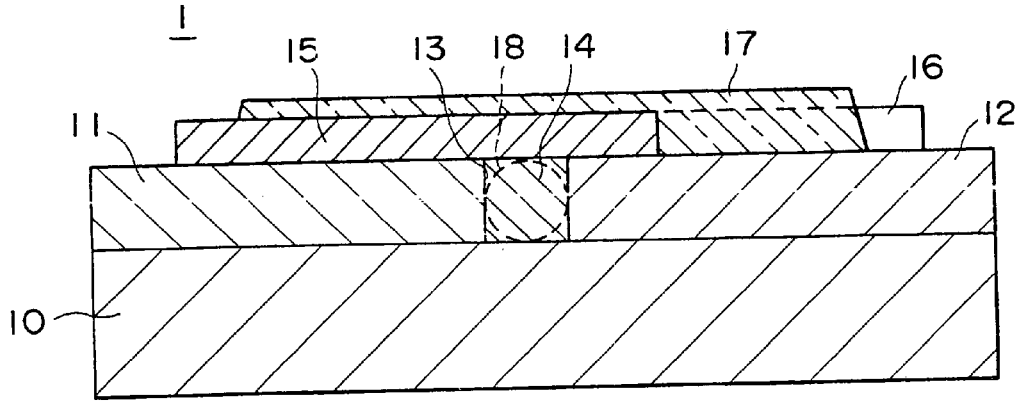
FIG. 2 is a cross-sectional view taken along line A—A in FIG. 1.
Figure 3:
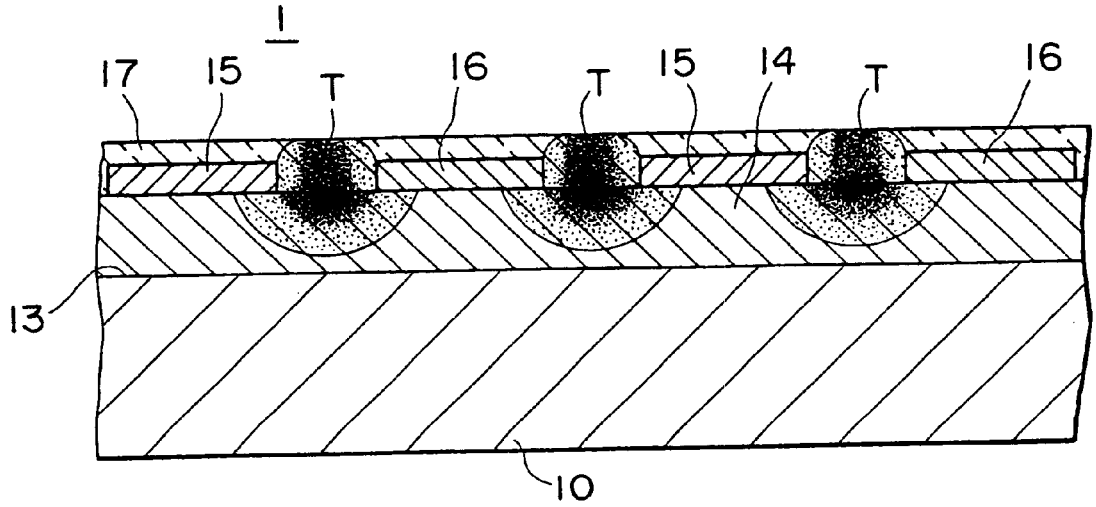
FIG. 3 is a cross-sectional view taken along line B—B in FIG. 1, FIGS. 4 to 8 are views for illustrating an example of manufacturing steps of the thermal head.

In FIGS. 1 to 3, a thick film thermal head 1 in accordance with an embodiment of the present invention comprises a substrate 10 which is formed of an electrical insulating ceramic material such as calcined ceramic. A pair of thin plates 11 and 12, which are heat-resistant and electrical insulating, are fixed to the upper surface of the substrate 10 so that their side surfaces are opposed to each other with a pair of spacers 18 sandwiched therebetween. Thus a linear gap 13 is formed between the thin plates 11 and 12. The thin plates 11 and 12 may be formed of heat-resistant resin or ceramic. An electrical conductive resistance heater 14 is embedded in the gap 13. First and second strip-like electrodes 15 and 16 are formed on the resistance heater 14 to extend across the resistance heater 14. The first and second electrodes 15 and 16 are alternately arranged in the longitudinal direction of the resistance heater 14. The first and second electrodes 15 and 16 are in contact with the resistance heater 14 at their one end portions and extend in opposite directions from their respective one end portions. A wear-resistant film (protective layer) 17 which is of glass or the like and has a flat upper surface is formed to cover the resistance heater 14 and the central portions of the first and second electrodes 15 and 16. The thermal head 1 of this embodiment is brought into contact with a stencil material at the upper surface of the wear-resistant film 17.

The side surfaces of the thin plates 11 and 12 should be highly smooth. For example, the smoothness of the side surfaces of the thin plates 11 and 12 should be about ±5 $\mu$m for a length of 300 mm. Further, the spacers 18 defining the width of the gap 13 are preferably small balls or small cylindrical bodies which can be formed with little fluctuation in dimension. The thickness of the thin plates 11 and 12 defines the depth of the gap 13.

As described above, the thin plates 11 and 12 may be, for instance, heat-resistant resin plates or ceramic plates. As the heat-resistant resin, polyimide resin of tetracarboxylic acid-aromatic diamine-siloxane (maximum heat resistance: about 600° C.) is suitable.

The first and second electrodes 15 and 16 are connected to a control circuit (e.g., a driver IC) through wire bonding.

As shown in FIG. 3, when power is applied to the first and second electrodes 15 and 16, parts of the resistance heater 14 between the first and second electrodes 15 and 16 generates heat from the upper surface thereof. The heat T is transferred through the wear-resistant film 17 toward the upper surface thereof and thermally perforates the stencil material. (In FIG. 3, the parts where the density of black dots is high are high in temperature.) That is, each of the parts of the resistance heater 14 between the first and second electrodes 15 and 16 corresponds to one perforation and forms one resistance heater element. Further, the heat generated by the resistance heater 14 is transferred to the substrate 10 through the bottom surface of the resistance heater 14 and dissipated.

As shown in FIG. 1, the longitudinal direction of the resistance heater 14 is the main scanning direction X corresponding to the direction of width of the stencil material and the direction perpendicular to the main scanning direction X is the sub-scanning direction Y corresponding to the direction in which the stencil material is conveyed.

Though the linear gap 13 is rectangular in cross-section in the embodiment described above, the linear gap may be U-shaped, V-shaped or trapezoidal in cross-section. The cross-sectional shape of the gap 13 can be of a desired shape by changing the shapes of the side surface of the thin plates 11 and 12. When the cross-sectional shape of the gap 13 differs, transfer of heat to the heat conductive layer 11 somewhat differs though heat generating characteristic is substantially the same.

An example of manufacturing steps of the thermal head 1 shown in FIGS. 1 to 3 will be described with reference to FIGS. 4 to 8, hereinbelow. The manufacturing steps basically comprise the steps of positioning a pair of thin plates 11 and 12 on a surface of the substrate 10 so that side surfaces of the thin plates 11 and 12 are opposed to each other with spacers 18 therebetween to form a thin gap 13 therebetween, fixing the thin plates 11 and 12 to the substrate 10, embedding an elongated resistance heater 14 in the gap 13, forming the electrodes 15 and 16 by forming metal film over the surface of the plates 11 and 12 and photo-etching the metal film into electrodes, and forming the wear-resistant film 17.

Figure 4:
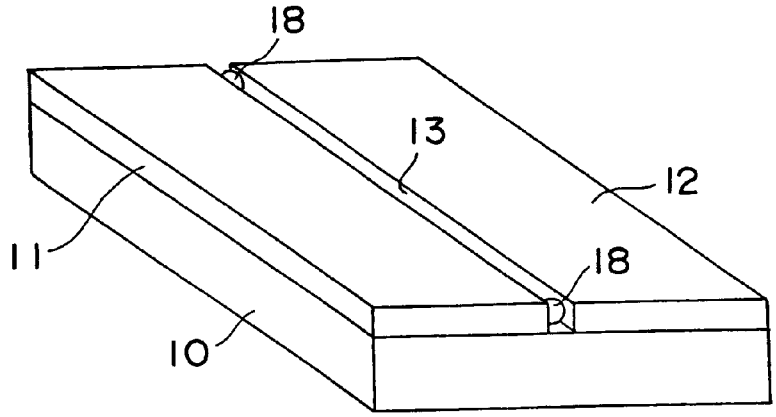

As shown in FIG. 4, an electrical insulating ceramic substrate 10 of a predetermined thickness is first prepared and a pair of thin plates 11 and 12 are positioned on a surface of the substrate 10 so that side surfaces of the thin plates 11 and 12 are opposed to each other with spacers 18 therebetween to form a thin gap 13 therebetween. The thin plates 11 and 12 and the substrate 10 are temporarily fixed in this state with the thin plates 11 and 12 urged toward each other and toward the substrate 10 under certain force by a suitable jig. Then heat-resistant adhesive (e.g., severe-heat-resistant polyimide) is injected between the thin plates 11 and 12 and the substrate 10 by a syringe or the like through the gap 13 and is heated to solidify. It is preferred that adhesive be diluted by solvent to about 1% and low in viscosity. Otherwise, thermoset epoxy adhesive may be coated on the surface of the substrate 10 in advance and heated after the plate 11 and 12 are bonded to the substrate 10.

When the width of the gap 13 or the diameter of the spacers 18 is 30 to 50 $\mu$m, a thermal head having a resolution of 400 dpi can be obtained. The depth of the gap 13 depends upon the thickness of the thin plates 11 and 12 and is generally about 30 to 50 $\mu$m.

Figure 5:
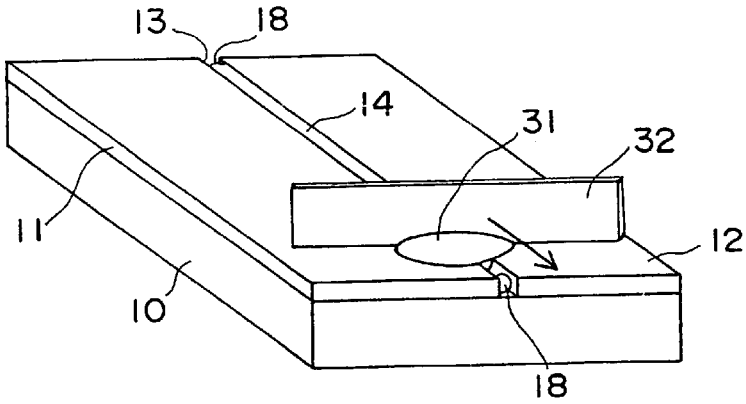

Then paste 31 for forming a resistance heater 14 is filled in the linear gap 13 by a squeegee 32 as shown in FIG. 5. Then the paste 31 is baked and solidified, thereby forming the resistance heater 14. Though ruthenium oxide paste is suitable for the paste 31, electrical conductive carbon paste may be used.

Figure 6:
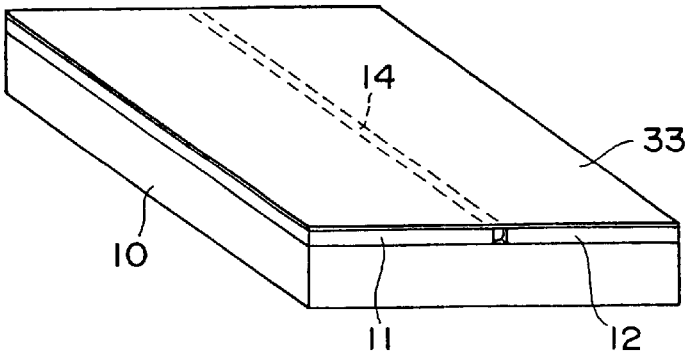

Thereafter metal film 33 of paste of gold or other metal for forming the electrodes 15 and 16 is formed over the entire upper surface of the substrate 10 including the upper surface of the resistance heater 14 by silk screening as shown in FIG. 6. The metal film 33 is subsequently heated to be fixed.

Figure 7:
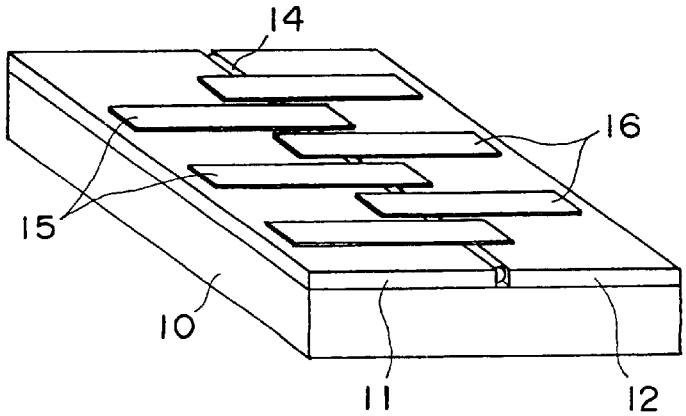

Then photoresist is coated over the fixed metal film 33 and is exposed to light in a pattern of first and second electrodes 15 and 16. Then the photoresist is developed and removed to expose the metal film 33 except the parts corresponding to the electrodes 15 and 16. The exposed part of the metal film 33 is removed by etching with the part covered with the photoresist left there, whereby the first and second electrodes 15 and 16 are formed in a predetermined pattern as shown in FIG. 7.

Figure 8:
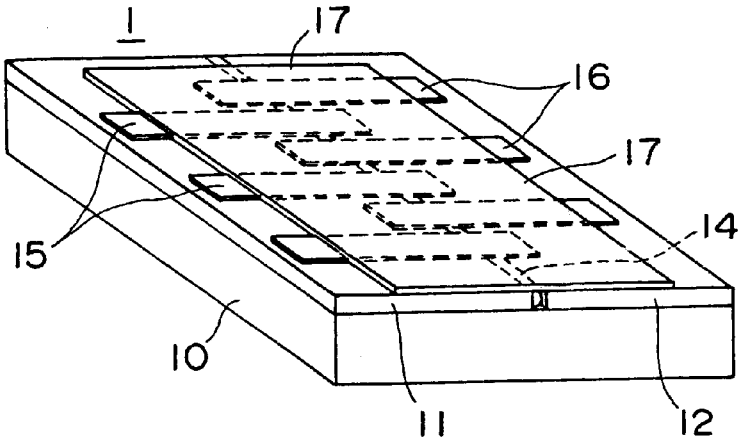
Figure 9:
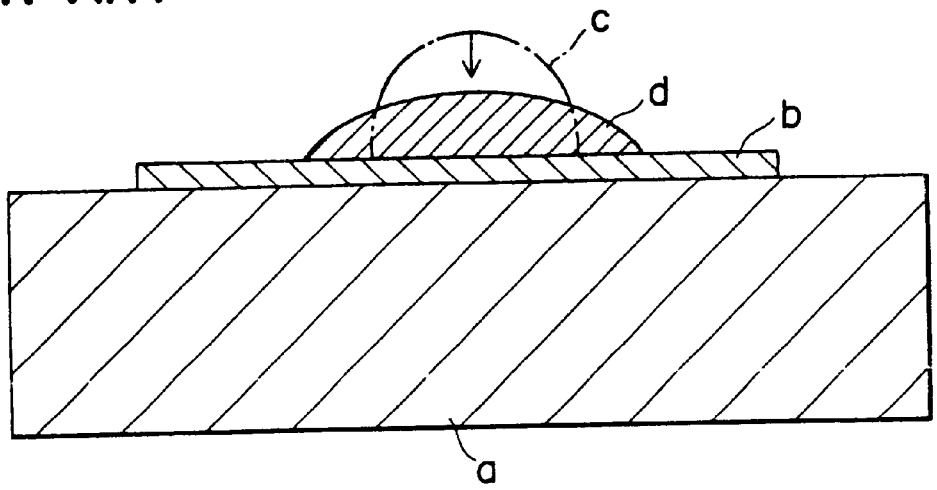
FIG. 9 PRIOR ART
FIG. 9 is a cross-sectional view showing formation of the resistance heater in a conventional thick film thermal head.

Thereafter, a glass composition is coated over the resistance heater 14 and the electrodes 15 and 16 with the outer end portions of the electrodes 15 and 16 exposed as shown in FIG. 8, and is heated to form a wear-resistant film 17, thereby obtaining a thermal head 1.

A driver IC is mounted and wire bonding step is carried out on the thermal head 1 thus obtained before the thermal head 1 is incorporated in a stencil making section of a stencil printer.

The spacers 18 are only necessary for forming the linear gap 13 and accordingly, may be removed after the thin plates 11 and 12 are fixed to the substrate 10.

In the thick film thermal head 1 in accordance with the embodiment described above, since the electrodes 15 and 16 are in contact with the surface of the resistance heater 14 which is brought into contact with the stencil material when making a stencil, heat is generated from the surface of the resistance heater 14 which is brought into contact with the stencil material and applied to the stencil material before propagating over a large distance and spreading wide. Accordingly, perforations can be small in size and resolution of the stencil can be improved, and at the same time, response to heat of the thermal head is improved. Further since being of a thick film type, the thermal heads can be produced at low cost without using a semiconductor manufacturing apparatus and can be produced in a large size.

Further, since the resistance heater 14 is in contact with the substrate 10 at its bottom surface and with the thin plates 11 and 12 at its side surfaces, heat generated by the resistance heater 14 is constantly dissipated and the heat generating areas cannot spread wide.

Further, since the resistance heater 14 is embedded in the gap 13, the width of the resistance heater 14 is limited to the width of the gap 13, whereby the heat generating areas can be confined narrow also in the sub-scanning direction and the size of the perforations can be small also in the sub-scanning direction. Further since the thermal head of the embodiment described above is flat at the surface to be brought into contact with the stencil material, resin grounds cannot be generated during perforation of the stencil material.

In addition, all of the contents of Japanese Patent Application Nos. 11(1999)-227330 and 2000-214658 are incorporated into this specification by reference.

What is claimed is:

1. A thick film thermal head, comprising:

an electrical insulating substrate, a pair of heat-resistant electrical insulating plates fixed to a surface of the substrate, each of the plates having a side face, the side faces being opposed to and spaced from each other to form a gap therebetween, a removable spacer means disposed in the gap;

an elongated resistance heater embedded in the gap; and a plurality of electrodes formed on a surface of the heat-resistant electrical insulating plates in contact with the resistance heater and arranged in a longitudinal direction on the resistance heater.

2. A thick film thermal head as defined in claim 1, wherein the electrodes comprise alternate first and second electrodes and parts of the elongated resistance heater between the first and second electrodes generate heat when electric power is applied across the first and second electrodes.

3. A thick film thermal head as defined in claim 1, wherein the substrate is made of calcined ceramic.

4. A thick film thermal head as defined in claim 1, wherein the spacer means is disposed between the heat-resistant electrical insulating plates to define the width of the gap.

5. A thick film thermal head as defined in claim 4, wherein the spacer means comprises a small ball.

6. A thick film thermal head as defined in claim 4, wherein the spacer means comprises a small cylindrical body.

7. A thick film thermal head as defined in claim 1, the heat-resistant electrical insulating plates are fixed to the surface of the substrate by an adhesive.

8. A thick film thermal head as defined in claim 1, wherein the heat-resistant electrical insulating plates are made of heat-resistant resin.

9. A method of making a thick film thermal head, comprising the steps of:

positioning a pair of heat-resistant electrical insulating plates on a surface of an electrical insulating substrate so that side surfaces of the heat-resistant electrical insulating plates are opposed to each other;

locating a spacer means between the heat-resistant electrical insulating plates to form a gap therebetween;

fixing the heat-resistant electrical insulating plates to the substrate;

embedding an elongated resistance heater in the gap;

removing the spacer means from the gap; and providing a plurality of electrodes in a longitudinal direction of the resistance heater on the surface of the heat-resistant electrical insulating plates in contact with the resistance heater.

10. A thick film thermal head, comprising:

an electrical insulating substrate;

a pair of heat-resistant electrical insulating plates fixed to a substrate, each of the plates having a side face, the side faces being opposed to and spaced from each other to form a gap therebetween;

a removable spacer disposed in the gap, the spacer comprising a cylindrical body;

an elongated resistance heater embedded in the gap; and a plurality of electrodes formed on a surface of the heat-resistant electrical insulating plates in contact with the resistance heater along a longitudinal direction thereon.

11. A thick film thermal head as defined in claim 10, wherein the cylindrical body spacer comprises at least one small ball.

* * * * *